US005520718A

United States Patent [19]

Keilman et al.

[11] Patent Number: 5,520,718

[45] Date of Patent: May 28, 1996

[54] STEELMAKING DEGASSING METHOD

[75] Inventors: Leonard M. Keilman, Crown Point, Ind.; William F. Flanagan, Jr., Chicago, Ill.; James E. Bradley, Wheatfield; Shankverm R. Balajee, Munster, both of Ind.

[73] Assignee: Inland Steel Company, Chicago, Ill.

[21] Appl. No.: 300,404

[22] Filed: Sep. 2, 1994

[51] Int. Cl.[6] ..... C21C 7/10

[52] U.S. Cl. ..... 75/508; 266/210

[58] Field of Search ..... 266/208, 209, 266/210; 75/508, 509

[56] References Cited

U.S. PATENT DOCUMENTS

| | | | |
|---|---|---|---|
| 3,581,803 | 6/1971 | Finkl | 266/208 |
| 3,649,246 | 3/1972 | Fulton et al. | 75/60 |
| 3,955,964 | 5/1976 | MacDonald et al. | 75/13 |
| 4,104,057 | 8/1978 | Maas et al. | 75/508 |
| 4,378,242 | 3/1983 | Harris et al. | 75/508 |
| 4,541,862 | 9/1985 | Finkl et al. | 75/12 |
| 4,545,815 | 10/1985 | Tóth et al. | 75/49 |
| 4,604,137 | 8/1986 | Yamada | 75/49 |
| 4,810,286 | 3/1989 | Schlichting et al. | 75/49 |
| 4,979,983 | 12/1990 | Nishikawa et al. | 75/511 |
| 4,994,108 | 2/1991 | Hammagami et al. | 75/508 |
| 5,242,484 | 9/1993 | Schonewolf et al. | 75/508 |

FOREIGN PATENT DOCUMENTS

| | | |
|---|---|---|
| 53-011114 | 2/1978 | Japan . |
| 59-067310 | 4/1984 | Japan . |
| 4180512 | 6/1992 | Japan . |

OTHER PUBLICATIONS

"Production of Steel Castings," Metals Handbook, Edited by Taylor Lyman, American Society For Metals, 8th Edition, vol. 5, Forging and Casting Dec. 1970, pp. 380–383.

"Vacuum Degassing of Steel For Ingots," The Making, Shaping and Treating of Steel, Edited by Harold E. McGannon, United States Steel, Ninth Edition Dec. 1971, pp. 591–598.

Okamoto, S. et al., "The Behavior of Hydrogen in Molten Steel During Steelmaking Processes," Proceedings of the Seventh International Conference on Vacuum Metallurgy (Special Melting and Metallurgical Coatings), Keidanren Kaikan, Tokyo, Japan, Nov. 26–30, 1982, pp. 1436–1443.

Paules et al., "Ladle Stirring & Stream Shrouding With Carbon Dioxide at Armco's Midwestern Steel Division," *70th Steelmaking Conference Proceedings,* vol. 70, Pittsburgh Meeting, Mar. 29–Apr. 1, 1987, pp. 129–132.

Abratis, H. et al., "Vacuum Ladle Treatment at the KMS Plant in Georgsmarienhütte," International Conference Secondary Metallurgy (Preprints), Sep. 21–23, 1987, pp. 278–290.

Kittenbrink, Douglas A. et al., "The Start–Up of the First RH–OB Vacuum Degasser in North America," 71st Steelmaking Conference Proceedings, vol. 71, Toronto Meeting, Apr. 17–20, 1988, pp. 1–12.

(List continued on next page.)

*Primary Examiner*—Scott Kastler

*Attorney, Agent, or Firm*—Marshall, O'Toole, Gerstein, Murray & Borun

[57] ABSTRACT

A method for degassing molten steel comprises the use of a lift gas which includes carbon dioxide. The inventive method includes providing a reaction zone isolated from the ambient atmosphere, and providing a bath of molten steel, at least a portion of which is located in the reaction zone. The pressure is reduced in the reaction zone to a sub-atmospheric pressure. A gas comprising carbon dioxide is supplied to the bath of molten steel in order to vertically circulate the molten steel. The method also preferably includes (a) supplying carbon dioxide, e.g., with a tuyere, to the reaction zone and (b) supplying carbon dioxide to the bath of molten steel, e.g., by gas bubbling or stirring. An apparatus for performing the method steps is also disclosed.

11 Claims, 4 Drawing Sheets

OTHER PUBLICATIONS

Schlichting, Mark et al., "Design and Start–Up of Inland's New Vacuum Degassing Facility," Iron and Steel Engineer, vol. 66, No. 3, Mar. 1989, pp. 47–52.

Balajee, S. R. et al., "Conversion of Inland Steel's No. 4 BOF Shop To Combined Blowing With LD–CB," 1990 Steelmaking Conference Proceedings, vol. 73, Mar. 25–28, 1990, pp. 319–329.

Szatkowski, Marian T. et al., "Recent Advances in Vacuum Metallurgy Process Control," Iron and Steel Engineer, Jul. 1990, pp. 25–32.

"Developments In Gas Application Technology," TechTopics, Airco Industrial Gases Sep. 1992.

Nagasaka, Tetsuya et al., "Reaction Kinetics of $CO_2$–$H_2O$ Gas Mixtures with Liquid Fe–C Alloys," ISIJ International, vol. 34 (Mar. 1994), No. 3, pp. 241–246.

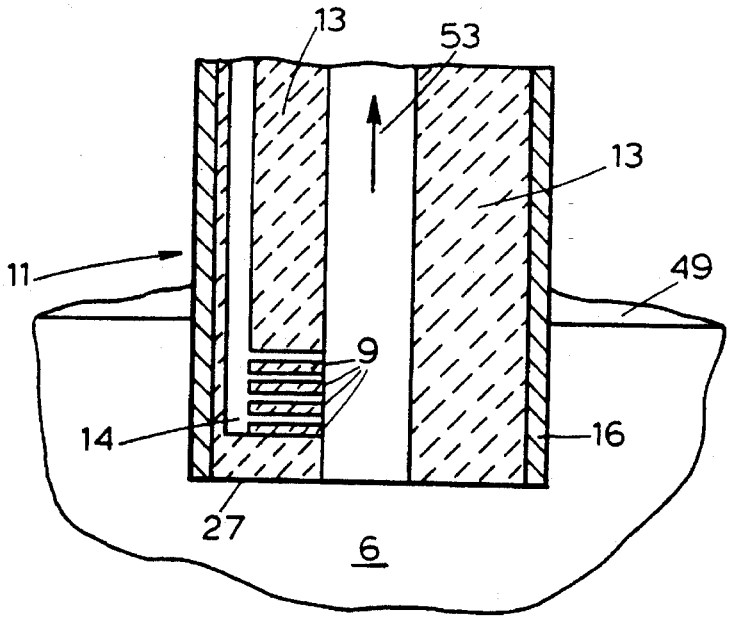
FIG. 5
FIG. 6
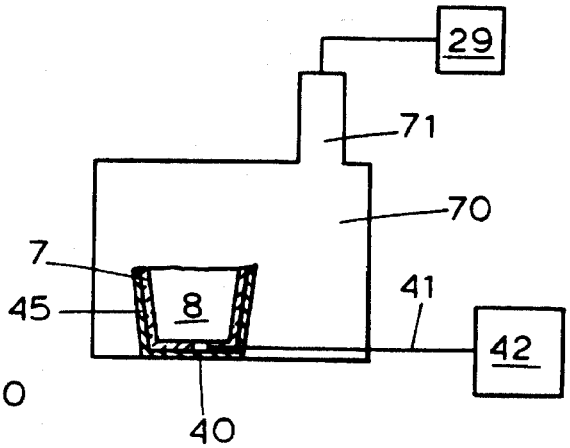
FIG. 7
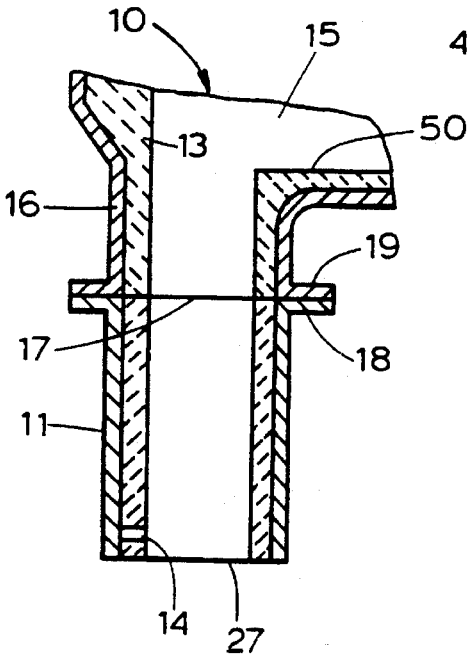

STEELMAKING DEGASSING METHOD

BACKGROUND OF THE INVENTION

The present invention relates generally to a method for reducing the content of certain materials in molten steel, by the employment of "vacuum degassing," and more particularly to a method in which oxygen blowing is employed in conjunction with vacuum degassing. Examples of such methods are the Ruhrstahl-Heraeus (RH) process or the "RH-OB" process wherein "OB" means oxygen blowing.

Vacuum degassing is a process which includes exposing molten steel to a low-pressure environment (e.g., a vacuum) in order to remove certain materials from the steel in the form of gases. Examples of gaseous materials which can be removed from the molten steel include hydrogen, oxygen, carbon monoxide, nitrogen, and sulfur. The material to be removed from the molten steel may also be a derivative of, or precursor to (e.g., an elemental component of), these gases; for example, carbon may be removed from steel in the form of carbon monoxide and/or carbon dioxide. Materials such as those listed above (or their derivatives or precursors), unless removed, can cause porosity, flaking, embrittlement, voids, inclusions, and other undesirable conditions in the steel after it is solidified.

A vacuum degassing process operates on the principle that reducing the pressure of (e.g., providing a vacuum treatment to) a closed environment surrounding molten steel will reduce the partial pressure of a gas derived from (e.g., produced by a chemical reaction in) that molten steel. Reducing the partial pressure of the gas will improve the thermodynamics of a reaction which releases the gas from the molten steel. The thermodynamics improve because a natural equilibrium state will attempt to reestablish itself between (a) the gas in the environment above the molten steel and (b) the gas present (e.g., in a dissolved state or in the form of the elements which react to form the gas) in the molten steel. There are three basic types of vacuum degassing: spray degassing, enclosed ladle degassing, and recirculation degassing.

As stated above, it may be desirable to remove hydrogen, for example, from molten steel by vacuum degassing. In such a process, the pressure in the environment above the molten steel is lowered by exhausting therefrom hydrogen and any other gas present in the environment above the molten steel. Removal of hydrogen gas reduces the partial pressure of hydrogen in the environment above the molten steel, thereby shifting the equilibrium between (a) the hydrogen in the molten steel and (b) the hydrogen in the environment above the molten steel. As the process continues, the molten steel attempts to regain equilibrium by evolving hydrogen into the environment above, from which one may continue to exhaust hydrogen. This same principle may be utilized in order to remove other materials, such as oxygen and carbon, from the molten steel (e.g., as carbon monoxide gas), as further described below.

Stirring the molten steel bath facilitates the above-described mechanism because stirring causes the materials which are to be removed to rise from lower locations of the molten steel bath nearer to the surface of the molten steel, where these materials can be more readily removed from the molten steel into the atmosphere. For example, in the process known as ladle degassing, a heat of molten steel is placed into a ladle which is in turn placed inside a vacuum chamber, wherein the metal is exposed to low pressure and stirred either by a gas or by electrical induction.

In another type of vacuum degassing process, known as recirculation degassing (also referred to as circulation degassing), a stream from the main bath of molten steel is initially forced by atmospheric pressure into an evacuated degassing or treatment chamber wherein the steel there is exposed to low pressure. After exposure to low pressure, the molten steel flows out of the degassing chamber, and back to the main bath.

A Ruhrstahl-Heraeus or "RH" process (a type of recirculation degassing) typically employs a vertically disposed treatment vessel, downwardly from the bottom of which extend a pair of tubular members or conduits having open lower ends and which function as siphon tubes or "snorkel" tubes. This treatment vessel is preferably disposed directly above a ladle which contains a bath of molten steel covered with slag and including dissolved carbon and oxygen. This bath of molten steel is supplied from a primary steelmaking stage, such as from a basic oxygen furnace, electric arc furnace, or open hearth furnace. The ladle is raised until the lower open ends of the two snorkels extend below the slag layer which rests on top of the molten steel. The interior of the treatment vessel is evacuated through an exhaust outlet located near the top of the vessel, creating a sub-atmospheric low pressure environment in the vessel. The atmospheric pressure on the molten steel in the ladle causes the molten steel and slag cover in the snorkels to rise upwardly through the two snorkels into the interior of the treatment vessel.

A Dortmund-Hörder-Huttenunion or "DH" system is similar to an RH system, but differs in that the apparatus has only one snorkel, through which the molten steel both enters and exits the treatment vessel.

Generally in an RH system, stirring gas, such as argon or nitrogen, is introduced into a first snorkel to reduce the density of the molten steel therein. (Gas stirring can also be used in other degassing systems in which stirring is beneficial, such as DH systems and ladle degassing.) The effect of the differential in densities is that the relatively less dense molten steel enters the treatment vessel through the first snorkel (known as the "up leg" or "inlet snorkel") and the relatively denser molten steel exits the treatment vessel through the other snorkel (known as the "down leg" or "exit snorkel").

In the manner described above, the molten steel may be circulated from the ladle upwardly through the inlet snorkel into the interior of the treatment vessel. Once the molten steel has been treated in the treatment vessel, the molten steel flows downwardly through the exit snorkel back into the ladle (below the treatment vessel). The molten steel will continuously circulate into, and out of, the treatment vessel to allow for maximum exposure of the steel to the low pressure environment. When the molten steel is in the treatment vessel, it undergoes a process which facilitates the release of various gases from the molten steel (e.g., carbon monoxide and/or hydrogen), thereby reducing the content of such materials in the molten steel.

The introduction of the stirring gas, such as argon or nitrogen, into the molten steel at the inlet snorkel causes circulation of the molten steel, which increases the surface area of molten steel exposed to the reduced pressure within the treatment vessel. This procedure facilitates the treatment for the reasons described above. Such stirring gases are referred to as "lift gases" because these gases circulate the molten steel by causing the steel to rise into the treatment vessel. Use of a lift gas may, in some cases, provide an additional advantage in that the lift gas forms bubbles which can function as a carrier for the "impurity" gas (e.g., hydrogen) which is coming out of solution in the molten steel.

The use of argon as a stirring or lift gas has the disadvantage of being relatively expensive. Nitrogen, although less expensive than argon, is disadvantageous in that some of the nitrogen can dissolve in the molten steel, and for many types of steel it is desirable to limit the nitrogen content. Therefore, nitrogen generally cannot be used as a stirring or lift gas in the manufacture of ultra-low nitrogen grades of steel. Further, nitrogen will enter into the interstices of the lattice structure of solidified steel, which is undesirable because when elements such as nitrogen enter those interstices, the drawing (cold deforming) capabilities of the steel are reduced. Therefore, even for non ultra-low nitrogen grades of steel, the nitrogen content preferably should be below 100 parts per million (ppm). In many ultra-low carbon ("ULC") steels, titanium is added to stabilize the microstructure of the hardened steel. These titanium-stabilized steels, in particular, must generally have a low nitrogen content.

Continuing the above-described circulation procedure for a period of time results in the entire volume of the molten steel in the ladle being subjected to the degassing treatment. The total contents of the ladle, usually an entire heat of steel from a basic oxygen furnace (typically about 250 short tons (227 Mg) of molten steel), is typically circulated through the treatment vessel in about 1.5 minutes. The bath of molten steel in the ladle is typically recirculated through the treatment vessel for as long as it takes to reduce the content of a particular impurity material to a desired level. By way of example only, the total treatment time can be in the range of about 10 to about 50 minutes, depending upon the desired product and the process conditions that are present or employed.

As stated above, it may be desirable to remove carbon from molten steel. If the dissolved oxygen content in the molten steel is sufficiently high, this oxygen will react with carbon in the molten steel to produce carbon monoxide gas. The production of carbon monoxide gas will be limited, however, by the thermodynamics of the following reaction: $\underline{C}+\underline{O} \leftrightarrows CO$. Because it is desirable to have a high oxygen content in order to remove carbon from the molten steel as carbon monoxide gas (i.e., to force the above reaction to the right), the molten steel subjected to the treatment described above will typically be non-deoxidized before the treatment begins. The term non-deoxidized steel refers to molten steel which contains a substantial quantity of dissolved oxygen which has not been removed by reaction with a deoxidizing agent, such as aluminum or silicon.

Because the resulting carbon monoxide gas is insoluble in molten steel, the carbon monoxide gas escapes from the molten steel into the environment thereabove (which, in a vacuum degassing system, is closed to the outer atmosphere). The carbon monoxide is thereafter removed or exhausted from the enclosed environment through various means, for example the imposition and maintenance of a low-pressure in the environment surrounding the molten steel. This process removes both oxygen and carbon from the molten steel as carbon monoxide gas. Use of such a process, known as natural decarburization, allows production of steels with ultra low carbon contents (e.g., 0.002 wt. %).

As stated above, the reaction between carbon and oxygen to form carbon monoxide (CO) is an equilibrium reaction which can move in either direction, and may be shown as: $\underline{C}+\underline{O} \leftrightarrows CO$. The ability of the reaction to form carbon monoxide is (a) directly related to the dissolved carbon and oxygen content of the molten steel and (b) inversely related to the partial pressure of carbon monoxide in the atmosphere above the molten steel.

Initially, the non-deoxidized molten steel has a high dissolved oxygen content of about 50 to 600 ppm, for example, so that lowering the partial pressure of carbon monoxide, by exhausting carbon monoxide gas from the enclosed atmosphere above the molten steel, drives the reaction to produce carbon monoxide (i.e., to the right in the equation shown in the previous paragraph).

Further, when carbon monoxide is continuously withdrawn from the environment above the molten steel, thereby maintaining there a relatively low partial pressure of carbon monoxide (e.g., 200 torr or less), the reaction is continuously driven to form carbon monoxide. The net result is to reduce substantially the carbon content (and the dissolved oxygen content) of the molten steel. Generally, the lower the partial pressure of carbon monoxide which is maintained, the lower the carbon content which can be achieved in the molten steel.

The process described above is known as an RH process. A refinement of the RH process is known as an RH-OB process. In an RH-OB process, the treatment vessel is equipped with oxygen tuyeres or blowers in the sides of the vessel, generally at the lower part thereof. Oxygen can be blown through these tuyeres into the molten steel in the treatment vessel, and this provides several potential benefits.

More particularly, the oxygen can be utilized to accelerate decarburization, and this is known as forced decarburization. Forced decarburization provides faster processing of the steel in the vacuum degassing vessel than natural decarburization, which is desirable in that it maximizes utilization of downstream casting equipment, such as a continuous caster which can be scheduled to continuously cast the molten steel from the degassing vessel. Another advantage of forced decarburization is that the untreated molten steel can be tapped from the primary steelmaking furnace at a significantly higher carbon level and a significantly lower dissolved oxygen level than when the molten steel from the basic oxygen furnace is to be subjected to a vacuum degassing treatment which does not employ oxygen blowing (i.e., it employs natural decarburization, instead). Oxygen blowing increases the amount of carbon which can be removed from the molten steel by vacuum degassing at a given sub-atmospheric pressure, and is therefore particularly useful in the production of ultra-low carbon steels. Oxygen blowing also reduces the time period required to reduce carbon to the desired level at a given partial pressure of carbon monoxide.

In addition, in a treatment vessel equipped to provide oxygen blowing, the molten steel undergoing treatment can be reheated employing a process called aluminum reheating in which (1) aluminum is added to the molten steel and (2) oxygen is blown through the tuyeres, causing a reaction between the aluminum and the oxygen. Such a reaction is exothermic and produces heat. Aluminum reheating is disadvantageous in some respects because aluminum is relatively expensive and the aluminum oxide formed by the reaction during aluminum reheating must be flushed from the molten steel into the slag cover on the molten steel, and this requires additional recirculation time which in turn prolongs the process.

Carbon dioxide ($CO_2$) has been blown into molten steel in a basic oxygen furnace, and, during earlier stages of the primary steelmaking process conducted in that furnace, the $CO_2$ has helped lower the carbon content. However, the thermodynamics which exist during primary steelmaking limit the reduction in carbon content to no lower than about 0.03 wt. %, for example, when employing $CO_2$ for that purpose.

In some RH-OB processes, concentric tubular tuyeres are employed for forced decarburization. An inner concentric tube or conduit is used to conduct the tuyere gas (e.g. oxygen); an outer concentric tube or conduit is used to conduct a tuyere protection gas. In some operations, carbon dioxide has been used as a tuyere protection gas.

SUMMARY OF THE INVENTION

The present invention provides a method for removing materials (e.g., gases) from a bath of molten steel. The invention also provides apparatus for performing such a method.

The method includes providing a first, reaction zone isolated from the ambient atmosphere. At least a portion of the bath of molten steel is located in the reaction zone during performance of the method. The molten steel preferably inherently contains dissolved oxygen and carbon. After lowering the pressure in the reaction zone to a sub-atmospheric pressure, a gas including carbon dioxide is supplied to the bath of molten steel to vertically circulate or stir the molten steel in the bath.

In one embodiment of the invention, a ladle containing the entire bath of molten steel is located or provided in the isolated reaction zone. This type of process is referred to generally as ladle degassing.

According to another embodiment of the method, the molten steel may be vacuum degassed by a recirculation degassing method which includes providing a first, reaction zone, isolated from the ambient atmosphere, wherein a portion of the bath of molten steel is located during performance of the method. Communicating with the reaction zone is a second zone also containing a portion of the bath of molten steel. After lowering the pressure in the reaction zone to a sub-atmospheric pressure, a gas including carbon dioxide is supplied to the molten steel outside of the reaction zone. The supplied gas, which may be referred to as a lift gas, need not be completely made up of carbon dioxide, and may instead be a mixture of carbon dioxide with another suitable gas, such as argon or nitrogen.

The recirculation degassing method preferably includes a feature wherein an additional gas is supplied to the reaction zone. This gas preferably has the ability to aid in the chemical oxidation of the dissolved carbon present in the molten steel. Examples of suitable gases include carbon dioxide, oxygen, or mixtures thereof.

Reactions and/or activities which occur in the reaction zone could overlap into the second zone, and vice versa, depending upon the embodiment of the process which is employed, the processing conditions, and the process stage (i.e. beginning, middle or end).

The invention also includes apparatus which may be utilized in accordance with the above-described methods. The inventive apparatus includes (a) a treatment vessel which is isolated from the ambient atmosphere and (b) a ladle of molten steel. The apparatus preferably also includes (c) at least one conduit, known as a snorkel, which communicates between the treatment vessel and the ladle of molten steel. The inventive apparatus also includes a device (e.g., water ring pumps and/or steam ejectors) which reduces the pressure in the reaction zone to a sub-atmospheric pressure. Also provided is a lift gas line or conduit for supplying, to the molten steel, a gas which includes carbon dioxide, to vertically circulate the steel.

The use of carbon dioxide as described above gives excellent cost savings over other gases which are typically used. In some cases, the use of carbon dioxide may provide better processing results than gases which are typically used for these applications.

Other features and advantages are inherent in the method claimed and disclosed or will become apparent to those skilled in the art from the following detailed description taken in conjunction with the accompanying diagrammatic drawings.

BRIEF DESCRIPTION OF THE DRAWINGS

FIG. 5 is an enlarged, fragmentary view of a portion of the system shown in FIG. 1, illustrating a portion of a lift gas line in accordance with the invention;

FIG. 6 is a vertical sectional view of an embodiment of a ladle degassing system useful in accordance with the invention; and FIG. 7 is an enlarged, fragmentary sectional view of a portion of the system of FIG. 1.

DETAILED DESCRIPTION

The present invention enables one to produce many types of steel having predetermined compositions. More specifically, the invention controls the content of various materials which form gases when the steel is in molten form, including the content of derivatives or precursors of such gases.

Figure 1:
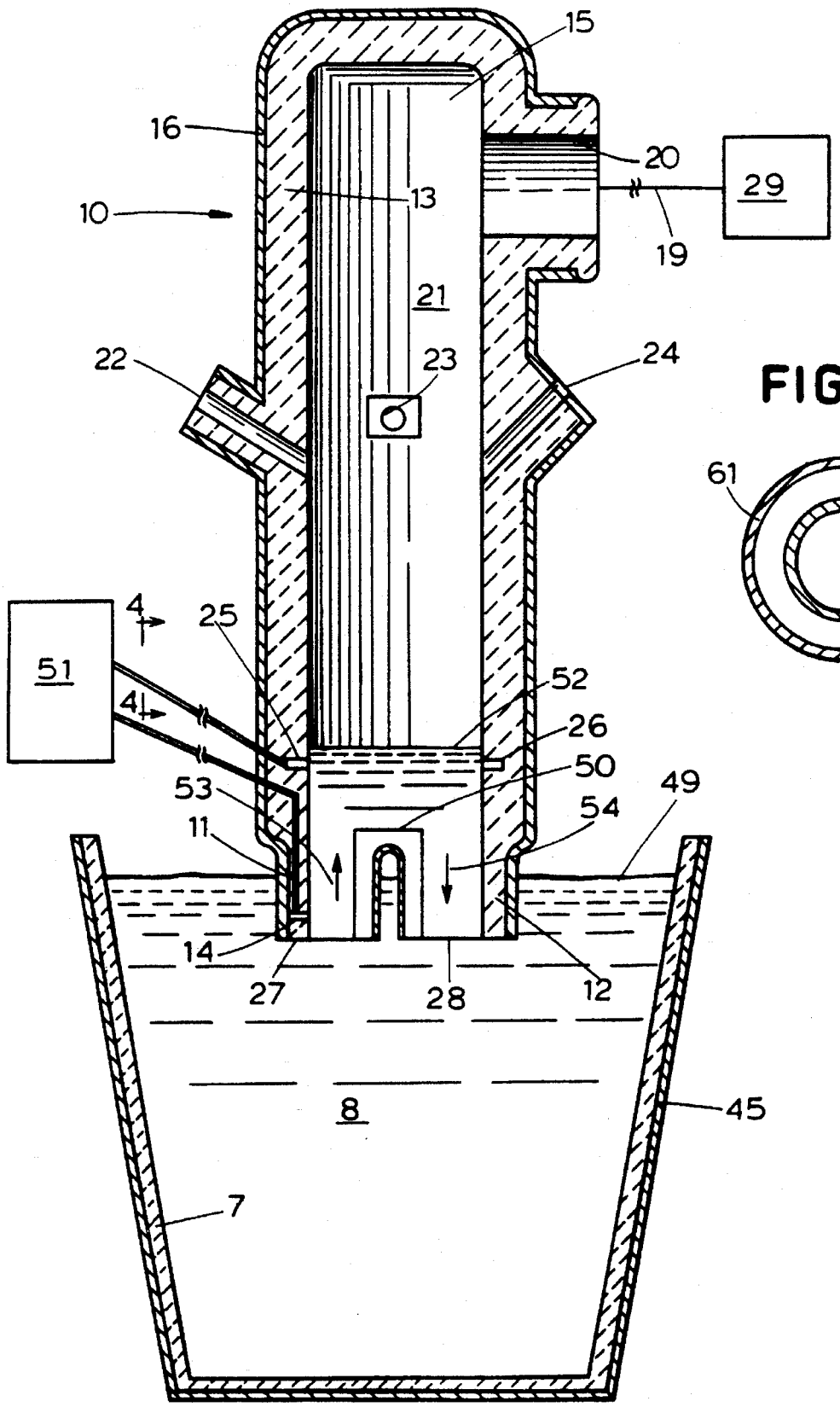
FIG. 1 is a vertical sectional view of an embodiment of an RH vacuum degassing system useful in accordance with the present invention.

An apparatus useful in accordance with one embodiment of the present invention is shown diagrammatically in FIG. 1 wherein a ladle 45 is utilized to contain a molten steel bath 8 in the interior of ladle 45. Ladle 45 preferably has an interior lining 7 which is made of refractory material. Ladle 45 typically has the capacity to hold a single heat having a weight of about 250 to about 260 short tons (about 227 to about 236 Mg). However, the amount of molten steel contained in the ladle is variable, depending, for example, upon the capacity of the particular vacuum degassing apparatus which is being utilized.

Ladle 45 is preferably disposed underneath a vacuum degassing apparatus, which is indicated generally at 10 and includes a treatment vessel 15. The gaseous interior of treatment vessel 15 (i.e., excluding any molten steel present therein) is designated by 21 in FIG. 1.

Vacuum degassing apparatus 10 in FIG. 1 is an RH type system, and therefore has two snorkels or legs 11 and 12 depending from vessel 15. For reasons which will become apparent below after describing the circulation of the molten steel, snorkel 11 may be referred to as the "up leg," and snorkel 12 may be referred to as the "down leg." Referring to FIG. 7, each snorkel 11 and 12 is preferably removable from vacuum degassing apparatus 10 for maintenance purposes, and preferably includes cooling means, for example piping (not shown), which circulates a cooling medium through that part of each snorkel adjacent its connection at 17 to treatment vessel 15. Conventional connectors, such as bolts (not shown), connect an upper flange 18 on a snorkel to a lower flange 19 on vessel 15. In one embodiment, the interior diameter of each snorkel is in the range of about 600 mm to about 644 mm; however, this diameter is variable depending on the other devices and conditions which are to be utilized in the process. Each such snorkel has a length (measured from its connection to vessel 15) of about 900 mm. The effectiveness of the recirculation operation (described below in greater detail) is directly proportional to the depth of submergence of a lift gas line (which will be identified and described below), the internal diameter of the snorkels, and the flow rate of the lift gas (also to be described below).

Vacuum degassing apparatus 10 has a metal shell 16 and an interior lining 13 which is made of refractory material and extends along the entire interior surface of apparatus 10, including the interior surfaces of snorkels 11 and 12.

An exhaust outlet 20 is preferably located at or near the top of treatment vessel 15. Connected to exhaust outlet 20 by a conduit 19 is apparatus (shown schematically at 29) for creating a low-pressure environment (e.g., a vacuum) in interior 21 of treatment vessel 15. Various types of apparatuses which can create such a low-pressure environment are known in the art, and include water ring pumps and/or steam ejectors. These apparatuses may be generally referred to as vacuum systems.

Located near the mid-section of treatment vessel 15 are (a) an alloy or solid addition inlet 24, through which alloying ingredients such as manganese may be introduced into treatment vessel 15, and (b) vessel preheating ports 22, 23 through either of which an electrode rod heater or a gas burner may be inserted to maintain an elevated vessel temperature between treatments. Ports 22 and 23 may be utilized to adjust the temperature of treatment vessel 15 to a desired level prior to beginning the degassing process.

Referring to FIGS. 1 and 5, a lift gas line 14 preferably extends through that portion of the body of apparatus 10 which forms snorkel 11. Line 14 delivers a lift gas to the interior of snorkel 11. Lift gas line 14 may be made of stainless steel tubing, for example, and in one embodiment has an interior diameter of about 3 mm. In order to obtain maximum stirring in apparatus 10, the distance between lift gas line 14 and the bottom 27 of snorkel 11 should be minimized. In one embodiment this can be 40 cm.

Vacuum degassing apparatus 10 includes expedients for supplying lift gas at a total flow rate of about 20 to $50\times10^3$ $cm^3$/sec., e.g. 36 to $43\times10^3$ $cm^3$/sec. Although lift gas line 14 is shown in FIG. 1 as terminating at a single outlet in refractory lining 13, the total flow of lift gas is preferably divided among multiple outlets in refractory lining 13 of snorkel 11. For example, thirteen individual outlets from lift gas line 14 may be utilized to provide a total flow rate of about 20 to $50\times10^3$ $cm^3$/sec., and in such a case, the flow rate at each of the thirteen outlets will be about $1.5–3.8\times10^3$ $cm^3$/sec. An embodiment of such a feature is shown in FIG. 5, wherein lift gas line 14 is shown as having multiple vertically spaced outlets 9 disposed in lining 13 of snorkel 11. In addition to (or in place of) outlets 9, the multiple outlets can be circumferentially spaced at a multiplicity of locations around the interior of snorkel 11.

The embodiment shown in FIG. 1 includes one or more conduits or lines which have the ability to supply a gas, such as oxygen or carbon dioxide, to vacuum degassing apparatus 10. Such conduits are known in the art as tuyeres. The apparatus shown in FIG. 1 has two tuyeres 25 and 26. In one embodiment, the tuyeres each may have an inside diameter of about 7 mm to about 15 mm, typically about 9 mm, and are preferably made of stainless steel. Preferably, there is a distance of about 90 mm between (a) the bottom of tuyeres 25 and 26 and (b) the bottom of treatment vessel 15, the latter bottom being at the connection 17 of vessel 15 to removable snorkels 11, 12 (FIG. 7); however, this distance is variable depending upon the desired process conditions and the other dimensions of the apparatus.

Figure 4:
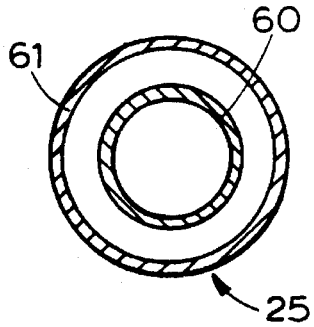
FIG. 4 is a sectional view, taken along line 4—4 in FIG. 1, of a tuyere used in accordance with the invention.

According to a preferred feature of the invention, tuyeres 25 and 26 preferably comprise concentric conduits. For example, referring to FIG. 4, a first, inner conduit 60 is disposed within a second, outer conduit 61. Conduit 60 preferably has an interior diameter of about 2 mm to about 6 mm. The exterior diameter of conduit 61 is preferably about 7 mm to about 15 mm. According to the feature illustrated in FIG. 4, conduits 60 and 61 allow for the supplying of two different gases to treatment vessel 15. The gas which flows in inner conduit 60 (e.g., oxygen) is generally referred to as the tuyere gas, whereas the gas which flows in outer conduit 61 is known more specifically in the art as the tuyere protection gas. In some embodiments, the same gas flows through both conduit 60 and conduit 61; however, when the gas flowing through conduit 60 is oxygen, the tuyere protection gas in conduit 61 is preferably a more inert gas such as argon.

Apparatus 10 preferably includes a conduit system associated with gas storage tanks (not shown) and represented diagrammatically by 51 in FIG. 1. Conduit system 51 can supply a selected gas to outer conduit 61 of tuyere 25, for example carbon dioxide, argon, nitrogen, natural gas, kerosine or mixtures thereof. Conduit system 51 also can supply the same, or a different, selected gas to inner conduit 60, for example, oxygen or carbon dioxide. According to a preferred embodiment, conduit system 51 can supply carbon dioxide through inner conduit 60, as well as through outer conduit 61. However, various other arrangements may be selected; for example, conduit system 51 can be adapted to supply carbon dioxide in conduit 60 and argon in conduit 61.

The tuyere gases are preferably supplied at a flow rate of about 20 to about $50\times10^3$ $cm^3$/sec. Tuyeres 25, 26 are shown in FIG. 1 as extending radially inwardly, toward vessel interior 21, in a horizontal disposition. In another embodiment, the tuyeres extend angularly downwardly toward interior 21.

Although apparatus 10 of FIG. 1 is shown as having tuyeres, the inventive method and apparatus need not utilize these features. As described herein in more detail, the tuyeres enable apparatus 10 to perform forced decarburization by a process known as "RH-OB," wherein "OB" denotes oxygen blowing. A vacuum degassing apparatus which does not have tuyeres, or other means of adding oxygen or a reacting gas, may only perform natural decarburization, as described above.

A preferred embodiment of the inventive apparatus includes a conduit system 51 which permits one to supply, to lift gas line 14, tuyere 25 and/or tuyere 26, a gas which is selected from a multiplicity of available gases. The particular desired specifications of the heat of steel to be treated in the apparatus will determine which gas or gases are suitable for that particular heat. Additionally, conduit system 51 preferably permits one to mix two or more gases upstream of the tuyeres, and of outlets 9 (FIG. 5), to form a composite lift gas or a composite tuyere gas. A composite lift gas may, for example, have a carbon dioxide content of about 10 to about 95 volume percent, with the balance being substantially argon or other gases.

Preferably, conduit system 51 permits one to simultaneously supply two or more gases (i.e., a composite gas) to lift gas line 14 or to tuyeres 25 and/or 26 at volume proportions which may be varied at will by the operator of conduit system 51. The operator may thereby select a composite gas which is suitable for use in a particular process depending upon (a) the desired final steel composition and (b) the steel composition at the time the selection is made. Selection of a composite gas (or alteration of a previously-selected composite gas) can preferably be made at any stage of the degassing operation. Alternatively, conduit system 51 could supply a mixture of gases at a predetermined, fixed ratio.

Figure 2:
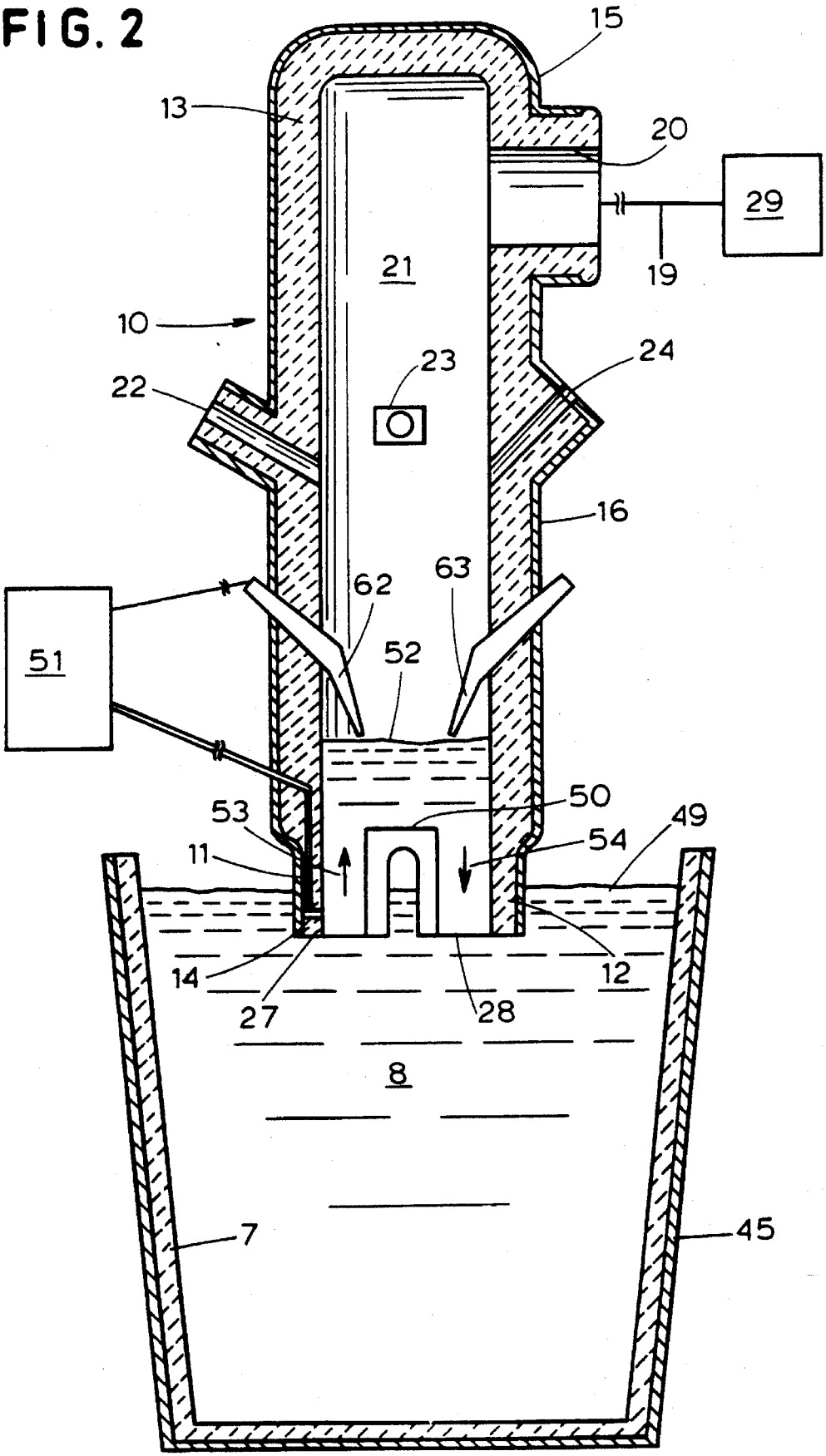
FIG. 2 is a vertical sectional view of an alternative embodiment of an RH vacuum degassing system useful in accordance with the present invention.

Referring now to FIG. 2, wherein like elements of FIG. 1 are represented by the same numerals in FIG. 2, there is shown an alternative embodiment of a RH-OB vacuum degassing apparatus in accordance with the invention.

A ladle 45, having refractory lining 7, is disposed beneath vacuum degassing apparatus 10. Apparatus 10 has an outer metal shell 16 and a refractory lining 13, and includes snorkels 11 and 12. Exhaust outlet 20 is connected by conduit 19 to a water ring pump and/or steam ejector system at 29, which creates a low-pressure environment in treatment vessel 15. The low-pressure environment in treatment vessel 15 causes molten steel from bath 8 to rise into apparatus 10. Similar to the embodiment of FIG. 1, apparatus 10 includes lift gas line 14 which provides a lift gas to the interior of snorkel 11. The lift gas preferably contains carbon dioxide.

As opposed to the side-tuyere embodiment shown in FIG. 1, FIG. 2 illustrates an alternative embodiment comprising semi-dip tuyeres 62, 63. Semi-dip tuyeres 62, 63 preferably aid in limiting the amount and severity of splashing within treatment vessel 15 during operation; splashing can cause skulling of the molten steel. Skulls are generally formed by the solidification of molten steel which splashes upwardly onto lining 13 of treatment vessel 15, and is undesirable because skulls left behind from a previous heat of steel may introduce undesired contents (e.g., nitrogen) into the next heat of steel treated by apparatus 10. Tuyeres 62, 63 are located at or near surface 52 of the molten steel in treatment zone 15, and each tuyere is aimed angularly downwardly and inwardly toward surface 52.

Figure 3:
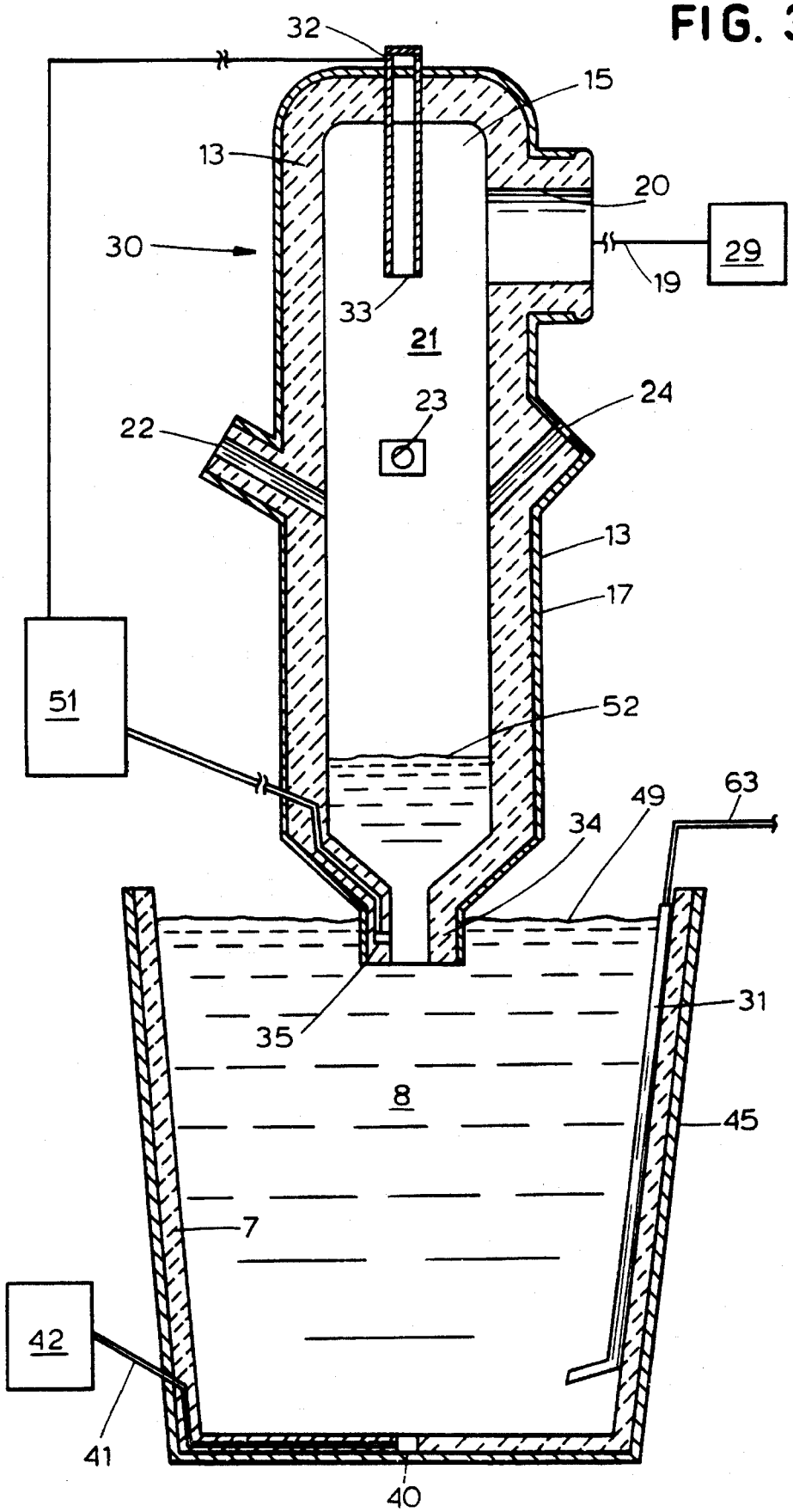
FIG. 3 is a vertical sectional view of a DH vacuum degassing system useful in accordance with the present invention.

Referring to FIG. 3, wherein like elements of FIGS. 1 and 2 are represented by the same numerals in FIG. 3, there is shown an alternative embodiment of a vacuum degassing apparatus 30 in accordance with the invention. The vacuum degassing apparatus shown in FIG. 3 is known as a DH system.

As in the embodiment of FIGS. 1 and 2, a ladle 45, having refractory lining 7, is disposed beneath vacuum degassing apparatus 30. Apparatus 30 has an outer metal shell 17 and a refractory lining 13, and includes a single snorkel 34. Exhaust outlet 20 is connected by conduit 19 to a water ring pump and/or steam ejector system at 29, which creates a low-pressure environment within interior 21 of treatment vessel 15. The low-pressure environment in treatment vessel 15 causes molten steel from bath 8 to rise to the level of surface 52 in apparatus 30. Similar to the embodiment of FIGS. 1 and 2, apparatus 30 may include a lift gas line 35 which supplies to the interior of snorkel 34 a lift gas containing carbon dioxide (preferably, substantially carbon dioxide).

As an alternative to the tuyere embodiments shown in FIGS. 1 and 2, the embodiment of FIG. 3 utilizes a vertically movable top lance tuyere 32 shown in a retracted position in FIG. 3. In one embodiment, in an operating position, the lower end 33 of lance tuyere 32 may be located about one meter above top surface 52 of the molten metal.

FIG. 3 illustrates another feature of the invention, referred to as "bottom bubbling," which preferably provides enhanced stirring of the molten steel in ladle 45. In accordance with this feature, a lance is preferably placed at or near the bottom of ladle 45, in order to supply a stirring (or "bubbling") gas thereto. A particular type of lance, referred to as a hockey stick lance, is shown at 31 in FIG. 3. Similar to the lift gas described above, the stirring gas from lance 31, supplied by a conduit 63, creates a volume or column of molten steel which has a lower density than the other molten steel in ladle 45. The molten steel having the lower density will flow upwardly, thereby causing increased circulation within bath 8 in ladle 45. The tuyeres and/or lances shown in a given figure of the drawing, in the group of figures comprising FIGS. 1, 2 and 3, can also be used with the apparatuses shown in each of the other figures in that group.

As an alternative to a lance, a porous plug 40 may be provided in lining 7 at the bottom of ladle 45. In such an embodiment, a gas supply 42 provides a bubbling gas, via a conduit 41, to porous plug 40.

Examples of gases useful with the bottom bubbling procedure include the following: carbon dioxide, argon, nitrogen, oxygen, and mixtures thereof. The bubbling gas preferably includes a substantial amount of carbon dioxide. Hockey stick lance 31 (or porous plug 40) is preferably disposed so that the bubbles which are formed rise to the top of ladle 45, and enter snorkel 34, so that the gas may be carried into vessel 15 and out of the system via exhaust outlet 20.

Although the bottom bubbling feature is described in conjunction with the embodiment of FIG. 3, this feature may be utilized in conjunction with any embodiment of the invention, including those of FIGS. 1, 2, and 6, for example.

A further alternative embodiment of the invention is illustrated diagrammatically in FIG. 6 wherein a ladle 45 having a refractory lining 7 contains a molten steel bath 8 and is located in an enclosed chamber (shown diagrammatically as 70). A water ring pump and/or steam ejector system 29 is connected to exhaust outlet 71 to create a low pressure environment in chamber 70. Similar to the embodiment of FIG. 3, ladle 45 includes porous plug 40 in lining 7 at the bottom of ladle 45. Gas supply 42 provides a bubbling gas via conduit 41 to ladle 45 in order to circulate the molten steel in bath 8.

A preferred embodiment of the inventive method will now be described, with reference to FIG. 1. The method described below is an RH-OB degassing method; however, the inventive method may be utilized in accordance with any vacuum degassing method which can benefit from stirring or recirculation. For example, applicable processes include other recirculation processes (e.g., RH or DH processes) and ladle degassing, which are described above.

Referring to FIG. 1, ladle 45 contains a bath 8 of molten steel received from a primary steelmaking process. Examples of primary steelmaking processes from which the molten steel may be supplied include basic oxygen furnace processes ("BOF" or "BOP") and electric arc furnace processes. Because vacuum degassing is performed after a primary steelmaking process, it may be referred to herein as a secondary steelmaking process. Molten steel bath 8 preferably has a temperature in the range of about 1560° C. to about 1680° C. (and more preferably about 1600° C. to about 1640° C.) prior to beginning the degassing operation. The BOF and the electric arc furnace each add oxygen to the molten steel. Therefore, when the molten steel is supplied from primary steelmaking, the steel generally is non-deoxidized, and may have an oxygen content, for example, of about 50 to about 800 ppm, preferably about 300 to about 600 ppm.

Ladle 45 is supplied with molten steel at the primary steelmaking station and is then delivered to a vacuum degassing station where ladle 45 is lined up below vacuum degassing apparatus 10, as shown in FIG. 1.

Once ladle 45 is sufficiently lined up underneath apparatus 10, conventional equipment is used to raise the ladle so that the bottoms 27, 28 of snorkels 11, 12 are submerged below the surface of molten steel bath 8. A layer of slag 49 will typically be present on top of the surface of molten steel; therefore, care must be taken to ensure that snorkel bottoms 27, 28 penetrate through slag layer 49 and into molten steel bath 8. Preferably, snorkel bottoms 27, 28 are submerged 9 to 15 in. (about 23 to 38 cm) below the surface of molten steel bath 8.

Once ladle 45 has been raised and snorkels 11 and 12 sufficiently submerged, the vacuum degassing system is preferably sufficiently isolated from the ambient atmosphere (i.e., the system is sufficiently resistant to leakage from the ambient atmosphere), and is ready for operation.

Following the above-described placement and lifting steps, a vacuum system 29 connected to exhaust outlet 20 creates a low-pressure environment (e.g., a vacuum) in interior 21 of treatment vessel 15. Interior 21 (which comprises the space above snorkels 11, 12 in FIG. 1) may be referred to as a treatment zone. The pressure in interior 21 can be varied depending upon other processing conditions; however, at the beginning of the degassing process, the pressure is preferably about 150 torr. During the course of the vacuum degassing operation, the pressure is preferably decreased to about 60 to about 1 torr, depending upon the steel undergoing treatment, the desired final steel composition and the processing steps employed. The low pressure in treatment vessel 15 causes a portion of the molten steel from bath 8 to enter treatment vessel 15 (i.e., filling snorkels 11 and 12 and preferably rising to a level above the vessel's hearth 50 (FIG. 1). Because some of the molten steel from ladle 45 enters treatment vessel 15, it generally will be necessary to further raise the height of ladle 45, to ensure that snorkel bottoms 27, 28 remain below the lowered surface of the molten steel in ladle 45.

The molten steel in treatment vessel 15 undergoes a vacuum degassing treatment, which functions according to the mechanisms described above in detail. Briefly, carbon in the molten steel preferably reacts with dissolved oxygen in the molten steel to form carbon monoxide gas. The carbon monoxide gas, which is insoluble in the molten steel, preferably comes out of the molten steel and enters that part of vessel interior 21 which is unoccupied by the molten steel. The low pressure environment maintained in interior 21 reduces the partial pressure of carbon monoxide gas in interior 21, thereby promoting the reaction, in the molten steel, of further carbon and further oxygen to form additional carbon monoxide gas.

In order to promote the effectiveness of the vacuum degassing operation, it is highly preferable to facilitate circulation of molten steel bath 8 in ladle 45. This may be accomplished by supplying (e.g., by injection) a gas through lift gas line 14 into the interior of snorkel 11. The gas supplied through lift gas line 14 is known as a lift gas. When lift gas is supplied to the molten steel in snorkel 11, this reduces the density of the molten steel in snorkel 11 compared to the density of the molten steel in snorkel 12. The difference in densities causes the molten steel to rise in snorkel 11, and descend in snorkel 12, as shown by the arrows 53 and 54 in FIG. 1. Thus, snorkel 11 is known as the "up leg," and snorkel 12 is known as the "down leg." This procedure causes the circulation of molten steel from ladle 45 into treatment vessel 15 and then back into ladle 45, to cause all of the molten steel to be sufficiently treated. Vessel interior 21, particularly that part of it occupied by molten steel (up to surface 52 in FIG. 1), comprises a zone for conducting a degassing reaction. Snorkel 11 is a second zone communicating with the zone described in the preceding sentence (the first zone). The degassing reaction and/or other activities which occur in the first zone may also occur, at least partially, in the second zone, and vice versa.

The conventional lift gas is argon or nitrogen. The method and apparatus of the present invention preferably utilize a lift gas which includes carbon dioxide, e.g. at least 5 vol. % $CO_2$. Preferably, the lift gas is substantially carbon dioxide (greater than 50 vol. % $CO_2$), and most preferably the lift gas consists essentially of carbon dioxide (e.g. 90 vol. % $CO_2$). The use of carbon dioxide provides beneficial results in the vacuum degassing process, while providing tremendous cost savings over conventionally-used argon gas which is about 7 to 10 times more expensive than carbon dioxide. Further, carbon dioxide is comparable to argon in terms of safety, during treatment and under ambient (atmospheric) temperatures. While nitrogen is also conventionally utilized, carbon dioxide is preferable over nitrogen for many applications, because it is generally desirable to limit the nitrogen content of steel to relatively low levels.

Because carbon dioxide is typically supplied in a liquid state by the provider, the apparatus of the invention preferably includes a conventional system for converting the liquid form of carbon dioxide to a gaseous form. If the carbon dioxide is supplied as a liquid, care must be taken to ensure that the carbon dioxide is not sent through lift gas line 14 as a liquid. The apparatus preferably includes a valve system (not shown) for regulating the pressure in the conduits (e.g., lift gas line 14) which supply the carbon dioxide.

At temperatures employed in steelmaking and in the treating of molten steel (i.e. temperatures greater than 1550° C.), the primary degassing reaction is $\underline{C}+\underline{O} \leftrightarrows CO$, for molten steel containing relatively high amounts of dissolved oxygen and some carbon. This reaction is governed by a number of factors including the molten steel bath's composition (primarily the $\underline{C}$ and $\underline{O}$ contents), the bath temperature, and the pressure in the atmosphere above the bath in the degassing vessel. Drawing a vacuum on the degassing system lowers the partial pressure of carbon monoxide, by exhausting carbon monoxide from the atmosphere above the bath, and drives the primary degassing reaction to the right to produce carbon monoxide. This lowers both the carbon and oxygen content of the molten steel bath.

When carbon dioxide ($CO_2$) is injected into the molten steel bath, the $CO_2$ reacts by dissociating into carbon monoxide and dissolved oxygen according to the reaction $CO_2 \rightarrow CO+O$. The resulting dissolved oxygen is available to react with carbon in the bath to form carbon monoxide as in the previously described reaction, $\underline{C}+\underline{O} \leftrightarrows CO$. The combination of these two reactions forms the basis for an overall reaction, $CO_2+\underline{C}\leftrightarrows 2\ CO$; this reaction is strongly pressure dependent, and, as in the reaction $\underline{C}+\underline{O}\leftrightarrows CO$, reducing the pressure in the atmosphere above the bath to produce a low partial pressure of CO allows the overall reaction involving $CO_2$ to proceed to the right to form CO, thereby further reducing the carbon content of the bath. Continuously withdrawing the gas from the atmosphere above the molten steel bath to maintain a low partial pressure of CO, allows the carbon in the bath to equilibrate at very low carbon levels in the reaction involving $CO_2$, similar to the effect on carbon of withdrawing gas in the primary degassing reaction, $\underline{C}+\underline{O}\leftrightarrows CO$.

The above-described decarburization due to $CO_2$ is limited by two reactions: (1) the oxidation of the molten steel by $CO_2$, i.e. $Fe+CO_2\leftrightarrows FeO+CO$; and (2) the dissociation of the resulting carbon monoxide. Carbon monoxide dissociation is the reverse of carbon monoxide formation in the equilibrium reaction $\underline{C}+\underline{O}\rightarrow CO$. The result is the apparent breakdown of carbon dioxide into dissolved carbon and oxygen, $CO_2\rightarrow\underline{C}+2\ \underline{O}$, thereby introducing carbon into the molten steel rather than removing carbon. However, the injection of carbon dioxide into the molten steel bath, in accordance with the present invention, does not generally impair the ability to remove substantial amounts of carbon from the molten steel. This is because the thermodynamic conditions which one can maintain during degassing (composition, temperature, and low partial pressure of CO) favor the production of carbon monoxide and allow only limited dissociation of carbon monoxide. For example, while injecting $CO_2$ into the molten steel and otherwise proceeding in accordance with the present invention, one can still reduce the carbon content to 0.003 wt. %. However, this beneficial situation for decarburizing can change in circumstances in which the amount of oxygen available for reaction with carbon is reduced or eliminated (e.g., when the molten steel has been deoxidized with aluminum). In such a case, it may be desirable to decrease or eliminate the use of carbon dioxide by employing another suitable gas (e.g., argon) as the lift gas or tuyere gas; and, as described above,the inventive apparatus preferably includes conduit system 51 for incorporating such an expedient.

Referring again to FIGS. 1 and 2, tuyeres 25 and 26 (or tuyeres 62 and 63 in FIG. 2) are preferably utilized to supply additional oxygen to the molten steel in treatment vessel 15, in order to promote the formation of carbon monoxide gas through forced decarburization, and in some embodiments, the conversion of CO to $CO_2$ through secondary combustion. The tuyeres 25, 26 and 62, 63 direct gas (i) along a path having a horizontal component and (ii) from a plurality of circumferentially spaced positions within the interior 21 of treatment vessel 15. As described in more detail above, the process of supplying additional oxygen to the molten steel (e.g., in an RH-OB process) is known as forced decarburization. During forced decarburization, the supply of additional oxygen promotes the production of additional carbon monoxide by driving the following reaction to the right: $\underline{C}+\underline{O}\leftrightarrows CO$. Additional benefits are preferably provided by a process referred to as secondary combustion or post-combustion. In secondary combustion, the supply of additional oxygen permits the following reaction to take place: $CO+\frac{1}{2}O_2\rightarrow CO_2$. In this reaction, carbon monoxide produced in the molten steel reacts with oxygen to form carbon dioxide. The reaction $CO+\frac{1}{2}O\rightarrow CO_2$ is beneficial because it is exothermic (i.e., it releases heat), thereby helping to keep treatment vessel 15 at a sufficiently high temperature to avoid skulling.

As opposed to supplying oxygen, tuyeres 25, 26 can alternatively supply a gas including carbon dioxide at or near surface 52 of the molten steel in treatment vessel 15. The carbon dioxide thus supplied can react with carbon to form additional carbon monoxide, by the following endothermic reaction: $CO_2+\underline{C}\leftrightarrows 2CO$. Alternatively, the carbon dioxide supplied through tuyeres 25, 26 can dissociate at high temperatures (including temperatures near the molten bath temperature of about 1560° C. to about 1680° C.) into carbon monoxide and oxygen: $CO_2\rightarrow CO+\underline{O}$. The oxygen produced by the latter reaction can be absorbed into (e.g., dissolve in) the molten steel wherein it can react with carbon to form further carbon monoxide. In either of the two above reactions, the formation of carbon monoxide beneficially removes additional carbon from the molten steel.

According to a preferred embodiment of the invention, once the operator of the system visually observes that the molten steel is sufficiently circulating through reaction vessel 15, a sample of the substantially untreated molten steel is taken. Through chemical analysis of this sample, the particular desired process parameters to be employed for the heat at hand may be determined. For example, selection of the length of time, the temperature and the pressure of the vacuum degassing process will depend upon (1) a determination of the characteristics of the substantially untreated molten steel (e.g., oxygen content, temperature and/or carbon content), in view of (2) the desired characteristics of the end product of the vacuum degassing process. A method for determining the processing parameters to be employed in the treatment vessel is described in U.S Pat. No. 4,810,286 to Schlichting et al., the disclosure of which is hereby incorporated by reference.

A preferred feature of the invention allows for simplified treatment of the molten steel. According to this feature, the molten steel is initially treated in the vacuum degasser for a period of time which may be referred to as "pretreatment." During pretreatment, the molten steel is treated until one or more selected measurable characteristics (e.g., oxygen content, temperature, and/or carbon content) reach predetermined levels. After pretreatment (i.e., once the predetermined levels of the selected characteristics have been achieved), the molten steel is preferably further treated according to a second treatment portion, which may be referred to as standard treatment. Because pretreatment provides a heat of steel having particular, known characteristics, the molten steel may thereafter be subjected to a standard treatment cycle applicable to all heats having the known characteristics.

In a preferred method, following the pretreatment described in the preceding paragraph, the molten steel may be subjected to a standard treatment which takes about 2 to about 14 minutes, and which reduces the carbon content of the molten steel to a predetermined desirable level.

At some point in the process, it may be desirable to alter or switch the lift gas which is supplied to the molten steel (e.g., so as to use an alternative lift gas). For example, depending upon the specification of the steel which is being manufactured, it may be desirable to switch from carbon dioxide to argon or nitrogen (particularly at a stage late in the degassing operation). More specifically, assuming it is desired to increase the nitrogen content of the heat of treated steel, one may do so by switching the lift gas from argon and/or carbon dioxide to nitrogen.

According to a preferred embodiment of the invention and depending on the type of steel being made, near the end of the vacuum degassing process (e.g., about 1 to about 6 minutes from the endpoint of the degassing process), the carbon dioxide lift gas may be switched to argon. (Where the apparatus includes a conduit system 51 which can mix two or more lift gases to form a composite lift gas, the argon content of the lift gas is preferably increased.) Such a switch is beneficial because use of carbon dioxide as the lift gas, after a substantial amount of the oxygen has been removed from the molten steel by reaction with carbon, may, under some conditions, be less effective than use of carbon dioxide at earlier process stages only.

More particularly, when the dissolved oxygen content becomes too low, there is an apparent breakdown of carbon dioxide into dissolved carbon and dissolved oxygen, and (a) the amount of carbon remaining after the breakdown becomes high relative to (b) the amount of carbon reacting with oxygen to form CO gas. When the retention of carbon thus formed becomes too great, it can be beneficial to switch from carbon dioxide to argon for the duration of the degassing operation. On the other hand, under certain conditions of temperature, oxygen ppm and pressure, the continued use of $CO_2$ as a lift gas when the dissolved oxygen content is low, allows one to maintain the carbon content at a desired minimum limit. This is useful in preventing excessive decarburization.

Thus as indicated in the preceding three paragraphs, the invention allows for substantial flexibility in the manufacture of steels having desired specifications.

Summarizing briefly with respect to the gases introduced into the molten steel during degassing, the lift gas (introduced at 14 in FIG. 1) includes (i) a first oxidizing gas consisting of carbon dioxide, during one stage of introduction of the lift gas, and comprises (ii) argon during another stage of introduction, after the one stage. In addition, a second oxidizing gas, which can be oxygen or carbon dioxide, is introduced into the reaction zone (at 25 in FIG. 1) concurrently with the introduction of carbon dioxide in the lift gas. Thus, as discussed above in connection with the embodiment of FIG. 1, carbon dioxide is introduced both in the lift gas (at 14) and into the reaction zone (at 25), while the totality of the oxygen which is introduced into the molten steel during degassing is introduced into the reaction zone (at 25), a location above tubular left leg 11.

Once one attains a desired level of carbon (or other material, and depending upon the particular degassing procedure which is utilized), the molten steel is preferably "killed" (i.e., aluminum or other reducing material is added to react with at least a portion of the oxygen which is still present in the molten steel). Killing of the molten steel preferably prevents further lowering of the carbon content of the steel by tying up any oxygen which might have been available to react with carbon in the molten steel. After killing, a desired amount of alloying metal (for example, from 100 to 8,000 kg per heat) can be added to meet the desired specifications of the final product.

Following the addition of alloying metals, the molten steel is circulated through apparatus 10 for a time which depends upon the amount of alloying metals (for example, about 4 minutes to about 12 minutes). After this circulation step, a final sample of steel is preferably taken from the heat for chemical analysis to ensure that the desired specifications have been attained. The vacuum system is thereafter shut down, allowing the pressure inside treatment vessel 15 to return to ambient pressure. Ladle 45 is then lowered away from vacuum degassing apparatus 10, so that snorkels 11 and 12 are not in contact with the surface of the molten steel, or with slag layer 49 which rests thereupon. The molten steel which was present in treatment vessel 15 and snorkels 11 and 12 will flow down into ladle 45. At this time, the vacuum degassing process is completed, and conventional slag conditioners are optionally added to the molten steel in bath 8.

After the vacuum degassing process is completed, and if there are no further pre-casting processing steps, the molten steel is preferably immediately supplied to a casting apparatus. The molten steel may have a temperature, for example, of about 1560° C. to about 1615° C. (preferably about 1575° C. to about 1595° C.) at the end of the degassing process. However, that temperature may be adjusted at apparatus 10 depending upon several variable factors, including the delay before casting (if casting is not immediate), and the type of casting apparatus which will be utilized. Both continuous casting and ingot casting operations are useful in conjunction with the invention. Examples of continuous casting processes include the following: slab casting, thin slab casting, billet casting, bloom casting, thin strip casting, and rheocasting.

In accordance with a preferred embodiment of the invention, each vacuum degassing system has more than one (and preferably two) vacuum degassing apparatuses 10. The multiple apparatuses 10 are alternately utilized, so that, for example, while one vacuum degassing apparatus 10 is in operation (the "treatment apparatus"), maintenance and repair may be performed on the other apparatus (the "non-treatment apparatus"). Carbon dioxide gas is preferably circulated through lift gas line 14 and tuyeres 25 and 26 in order to prevent the formation of skulls (solidified, residual metal) at or near lift gas line 14 and tuyeres 25 and 26.

Many different types of steel may be made in accordance with the inventive method. Although not limited to such, the invention is preferably utilized in the manufacture of lower carbon steels, for example those steels having carbon contents less than about 0.10 wt. %. Lower carbon steels include the following types (wherein preferred ranges of carbon contents are shown in parenthesis): low carbon steels (e.g., low carbon aluminum killed steel or "LC-AK") (0.015–0.10 wt. % C) , extra low carbon steels or "ELC" (0.01–0.02 wt. % C) , and ultra-low carbon steels or "ULC" (less than about 0.01 wt. % C). However, it should be understood that the invention is useful in the production of many different steel compositions, including any steel where it is desirable to limit the content of a gas which may be obtained from molten steel (including derivatives or precursors to such a gas). Among these steel compositions are medium carbon steels (0.10–0.30% C), high carbon steels (0.30% C and above) and alloy steels.

Ranges for some types of steel which may be made in accordance with the present invention are shown in the table below. Column A lists preferred composition ranges of LC-AK, column B lists preferred composition ranges of extra low carbon steel, and column C lists preferred composition ranges of ultralow carbon steel. All ranges are in wt. %.

| Element | A | B | C |
|---|---|---|---|
| Carbon | 0.02–0.10 | 0.005–0.03 | 0.0–0.01 |
| Manganese | 0.1–1.5 | 0.05–1.5 | 0.05–1.5 |
| Phosphorus | 0.0–0.1 | 0.0–0.1 | 0.0–0.1 |
| Sulphur | 0.0–0.05 | 0.0–0.05 | 0.0–0.05 |
| Silicon | 0.0–1.5 | 0.0–1.50 | 0.0–1.5 |
| Aluminum | 0.01–0.5 | 0.01–0.5 | 0.01–0.5 |
| Nitrogen | 0.0–0.05 | 0.0–0.05 | 0.0–0.02 |

The compositions listed above may optionally contain amounts of additional metals such as, but not limited to, niobium, antimony, chromium, titanium and boron (e.g., less than 0.5 wt. % of each), with the balance consisting essentially of iron.

The foregoing detailed description has been given for clearness of understanding only, and no unnecessary limitations should be understood therefrom, as modifications will be obvious to those skilled in the art.

We claim:

1. A method for producing a steel having a reduced carbon content, said method comprising the steps of:

providing a bath of molten steel containing carbon and dissolved oxygen;

exposing said bath of molten steel to the ambient atmosphere;

degassing said bath of molten steel, to lower the carbon and dissolved oxygen contents thereof;

said degassing step comprising employing a treatment vessel located above said bath of molten steel, said treatment vessel having an interior isolated from the ambient atmosphere and a tubular leg extending downwardly from said vessel interior into said bath of molten steel;

reducing the pressure in said vessel interior to a subatmospheric pressure to cause molten steel from said bath to rise through said tubular leg into said vessel interior, above said tubular leg;

introducing a lift gas, into the molten steel at a first location, in said tubular leg, to facilitate the circulation of molten steel from said bath into said vessel interior, during said degassing step;

at least a substantial part of said lift gas, during one stage of its introduction, being a first oxidizing gas consisting of carbon dioxide;

said lift gas comprising argon during another stage of introduction of the lift gas, after said one stage;

introducing a second oxidizing gas into the molten steel at a second location, in said vessel interior above said tubular leg, and concurrently with the introduction of said lift gas into the tubular leg;

said second oxidizing gas containing one of oxygen and carbon dioxide;

employing said first and second oxidizing gases to lower the carbon content of said molten steel;

the totality of the oxygen which is introduced into said molten steel, during said degassing step, being introduced at said second location;

and exhausting gas from said vessel interior above said molten steel, during said degassing step.

2. A method as recited in claim 1 wherein:

said lift gas consists essentially of carbon dioxide, during said one stage of introduction of the lift gas.

3. A method as recited in claim 1 or 2 and comprising:

discontinuing the introduction of carbon dioxide into said molten steel at said first location when the thermodynamic conditions within said vessel interior will cause further introduction of carbon dioxide to introduce carbon into said molten steel;

and thereafter employing argon as the lift gas during the remainder of the degassing step.

4. A method as recited in claim 3 and comprising:

lowering the carbon content to less than about 0.01 wt. %.

5. A method as recited in claim 1 or 2 and comprising:

introducing carbon dioxide at said first location until the thermodynamic conditions within said vessel interior will cause further introduction of carbon dioxide to introduce carbon into said molten steel;

and thereafter continuing the introduction of carbon dioxide into said molten steel.

6. A method as recited in claim 1 and comprising:

lowering the carbon content to a level in the range 0.01–0.02 wt. %.

7. A method as recited in claim 1 and comprising:

lowering the carbon content to a level above 0.015 wt. %.

8. A method as recited in claim 1 wherein:

said second oxidizing gas contains carbon dioxide.

9. A method for producing a steel having a reduced carbon content, said method comprising the steps of:

providing a bath of molten steel containing carbon and dissolved oxygen;

exposing said bath of molten steel to the ambient atmosphere;

degassing said bath of molten steel, to lower the carbon and dissolved oxygen contents thereof;

said degassing step comprising employing a treatment vessel located above said bath of molten steel, said treatment vessel having an interior isolated from the ambient atmosphere and a tubular leg extending downwardly from said vessel interior into said bath of molten steel;

reducing the pressure in said vessel interior to a subatmospheric pressure to cause molten steel from said bath to rise through said tubular leg into said vessel interior, above said tubular leg;

introducing a lift gas, with or without argon, into the molten steel at a first location, in said tubular leg, to facilitate the circulation of molten steel from said bath into said vessel interior, during said degassing step;

at least a substantial part of said lift gas, during one stage of its introduction, being a first oxidizing gas consisting of carbon dioxide;

introducing a second oxidizing gas into the molten steel at a second location, in said vessel interior above said tubular leg, and concurrently with the introduction of said lift gas into the tubular leg;

directing said second oxidizing gas (i) along a path having a horizontal component and (ii) from a plurality of circumferentially spaced positions within the interior of said treatment vessel;

said second oxidizing gas containing one of oxygen and carbon dioxide;

employing said first and second oxidizing gases to lower the carbon content of said molten steel;

the totality of the oxygen which is introduced into said molten steel, during said degassing step, being introduced at said second location;

and exhausting gas from said vessel interior above said molten steel, during said degassing step.

10. A method as recited in claim 9 wherein:

said second oxidizing gas contains carbon dioxide.

11. A method as recited in claim 1 wherein:

said lift gas contains carbon dioxide from substantially the beginning of the lift gas introducing step through said one stage.

* * * * *

UNITED STATES PATENT AND TRADEMARK OFFICE

CERTIFICATE OF CORRECTION

PATENT NO. : 5,520,718

DATED : May 28, 1996

INVENTOR(S) : Leonad M. Keilman, William F. Flanagan, Jr., James E. Bradley and Shankverm R. Balajee It is certified that error appears in the above-identified patent and that said Letters Patent is hereby corrected as shown below:

Column 12, lines 63-64, "$CO_2 \rightarrow CO + O$." should be --$CO_2 \rightarrow CO + \underline{O}$.--.

Signed and Sealed this

Fifteenth Day of October, 1996

*Attest:*

Bruce Lehman

BRUCE LEHMAN

*Attesting Officer*

*Commissioner of Patents and Trademarks*